US007011540B1

(12) United States Patent
Hu

(10) Patent No.: US 7,011,540 B1
(45) Date of Patent: Mar. 14, 2006

(54) MULTIDIRECTIONAL SOCKET ASSEMBLY FOR CONNECTION WITH ELECTRONIC ELEMENTS EXTENDING IN DIFFERENT DIRECTIONS

(76) Inventor: Tien-Tse Hu, 9 Alley 14, Lane 75, Nanking E. Rd., Sec. 4, Taipei (TW)

( * ) Notice: Subject to any disclaimer, the term of this patent is extended or adjusted under 35 U.S.C. 154(b) by 0 days.

(21) Appl. No.: 11/121,247

(22) Filed: May 3, 2005

Related U.S. Application Data

(60) Provisional application No. 60/655,598, filed on Feb. 24, 2005.

(51) Int. Cl.
*H01R 13/62* (2006.01)

(52) U.S. Cl. ..... 439/306; 439/541; 439/235; 439/954; 362/640

(58) Field of Classification Search ..... 439/578–585, 439/541.5, 540.1, 306, 322, 79, 394, 63, 439/403–404, 527, 541, 954, 824, 277, 638, 439/314, 320, 235, 242, 228; 174/59; 248/274.1, 248/278.1, 282.1, 284.1; 362/640–659
See application file for complete search history.

(56) References Cited

U.S. PATENT DOCUMENTS

| | | | | |
|---|---|---|---|---|
| 4,025,150 | A * | 5/1977 | Nordberg et al. | 439/218 |
| 4,559,421 | A * | 12/1985 | Lapke et al. | 200/51.1 |
| 4,797,121 | A * | 1/1989 | Hayward | 439/579 |
| 6,923,677 | B1 * | 8/2005 | Hsu | 439/531 |
| 6,929,387 | B1 * | 8/2005 | Hsu | 362/405 |
| 6,959,996 | B1 * | 11/2005 | Ip | 362/102 |

* cited by examiner

*Primary Examiner*—Gary F. Paumen
*Assistant Examiner*—Edwin A. Leon
(74) *Attorney, Agent, or Firm*—Jackson Walker, LLP

(57) ABSTRACT

A socket assembly includes a base, two first connection poles on the base and each having a first lateral hole, an assembly block having a central through hole to allow extension of the two first connection poles and pairs of first connection blocks formed on one side of the assembly block to sandwich the side hole. Each first connection block has a first threaded hole. At least one socket device has a threading for connection with an electronic element, a contact for providing power to an electronic element and two pairs of second connection blocks, and securing devices extending through the aligned second threaded hole and the first threaded hole as well as the first lateral hole and the second threaded hole to secure engagement between the at least one socket device and the assembly block.

5 Claims, 8 Drawing Sheets

MULTIDIRECTIONAL SOCKET ASSEMBLY FOR CONNECTION WITH ELECTRONIC ELEMENTS EXTENDING IN DIFFERENT DIRECTIONS

This application claims the benefit of Provisional Application No. 60/655,598, filed Feb. 24, 2005.

BACKGROUND OF THE INVENTION

1. Field of the Invention

The present invention relates to a multidirectional socket assembly, and more particularly to a multidirectional socket assembly having multiple sockets fixed onto a base so that electronic elements extending in different directions are able to connect to the socket assembly for power.

2. Description of Related Art

In an exhibition hall, demonstrators need to attract participants' attention such that how to present the product to the participants is the critical issue. It seems that a surrounding (360 degrees) lighting effect is the best choice to show the product to the exhibition-goers. Therefore, lateral light tubes and longitudinal light tubes are prepared to present the best appearance of the product. However, to supply power to the lateral light tubes and the longitudinal light tubes, the demonstrators need to have multiple sockets so as to supply electricity to the light tubes. It can be easily understood that the scattered sockets as well as the wiring extending from different sockets causes chaos in the exhibition site, not to mention how inconvenient it is to assemble the light tubes and the sockets in a compact area.

To overcome the shortcomings, the present invention tends to provide an improved multidirectional socket assembly to mitigate the aforementioned problems.

SUMMARY OF THE INVENTION

The primary objective of the present invention is to provide an improved multidirectional socket assembly to provide power to electronic elements simultaneously.

In one aspect of the present invention, the socket assembly of the present invention has a base with two first connection poles extending from a top face thereof and in parallel with each other, a hollow assembly block formed on the base and having a central through hole defined to allow the extension of the two connection poles and two second connection poles extending from opposite sides defining the central through hole and at least one socket device attached to the assembly block for power supply to at least one electronic element.

In yet another aspect of the present invention, the assembly block has multiple pairs of connection blocks formed on outer sides thereof to connect to the socket device.

A further aspect of the present invention is that the assembly block is substantially cubic/prismatic so that there are five socket devices attached to the assembly block for power supply.

Other objects, advantages and novel features of the invention will become more apparent from the following detailed description when taken in conjunction with the accompanying drawings.

DETAILED DESCRIPTION OF THE PREFERRED EMBODIMENT

Figure 1:
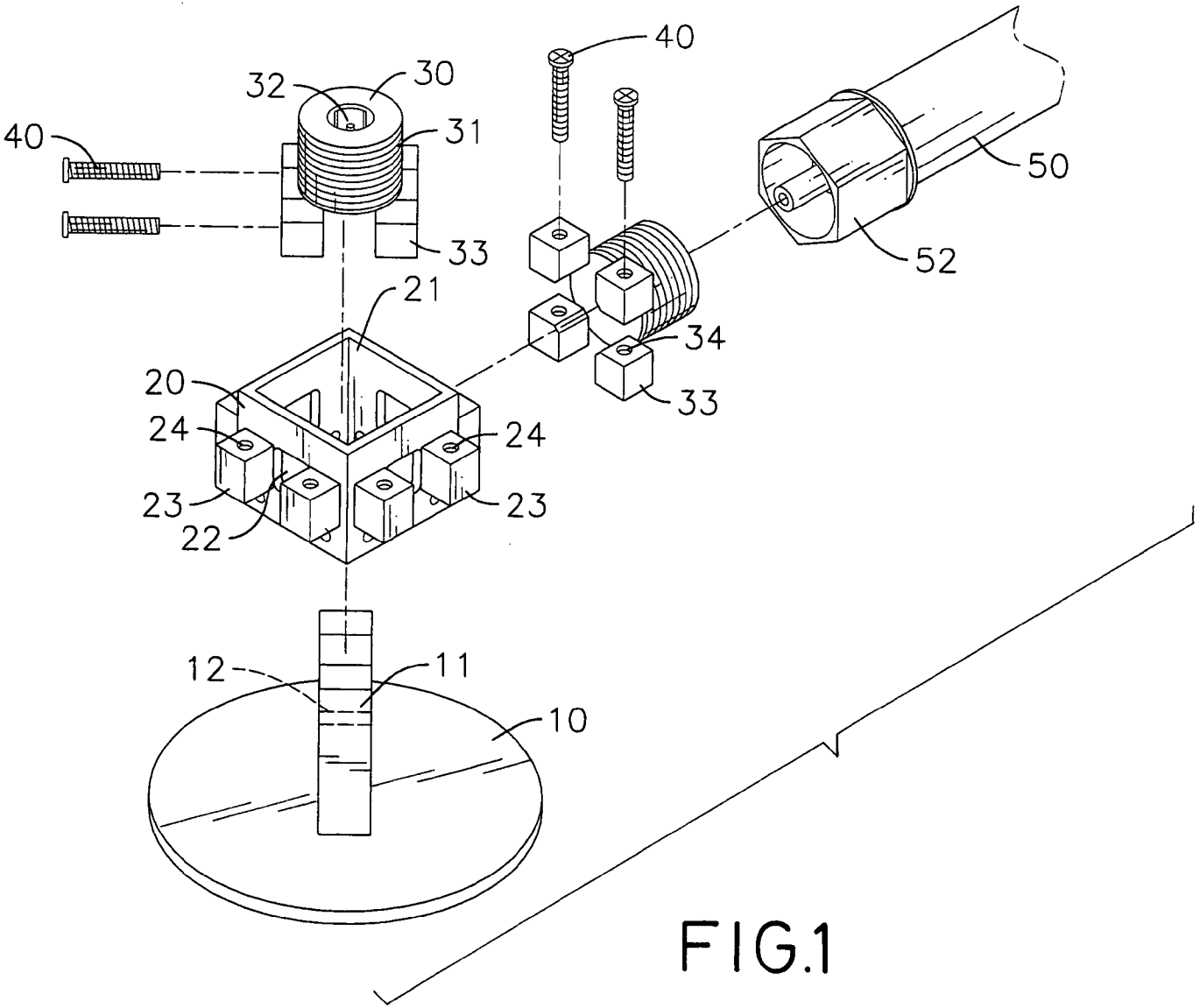
FIG. 1 is an exploded perspective view of the multidirectional socket assembly of the present invention.
Figure 2:
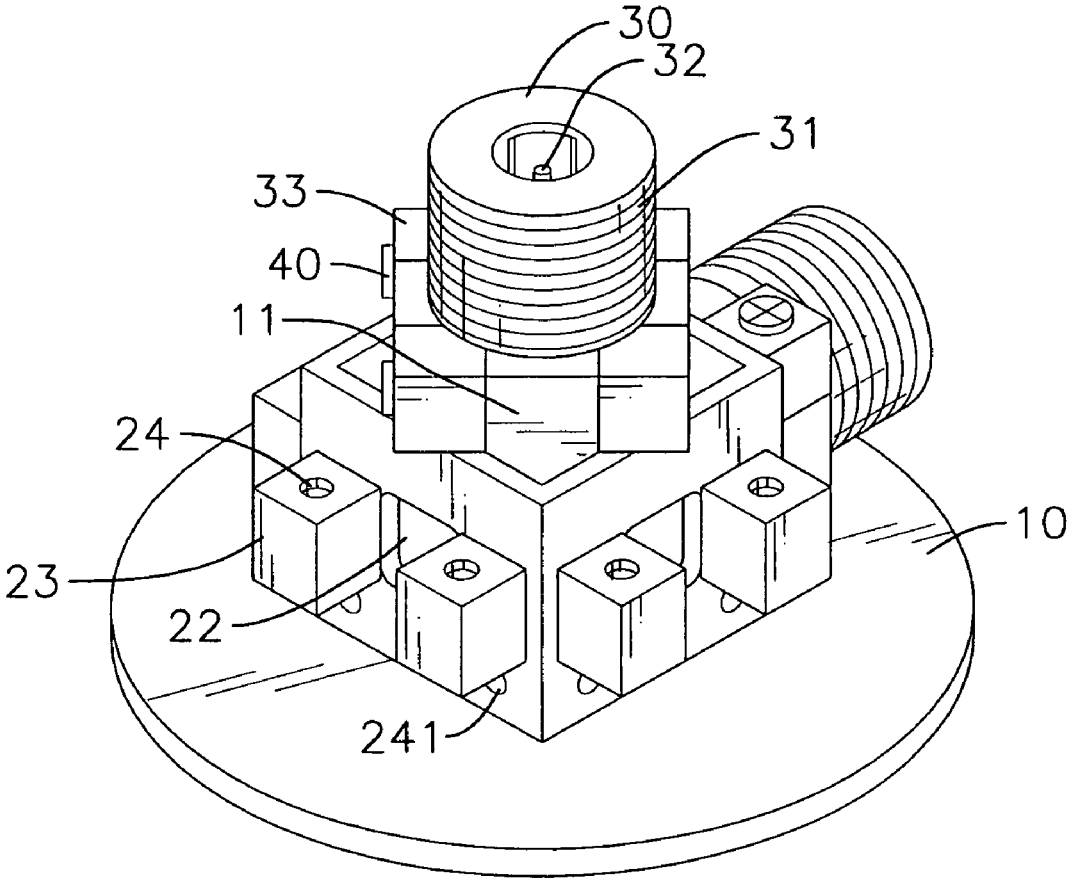
FIG. 2 is a perspective view of the combined multidirectional socket assembly in FIG. 1.
Figure 3:
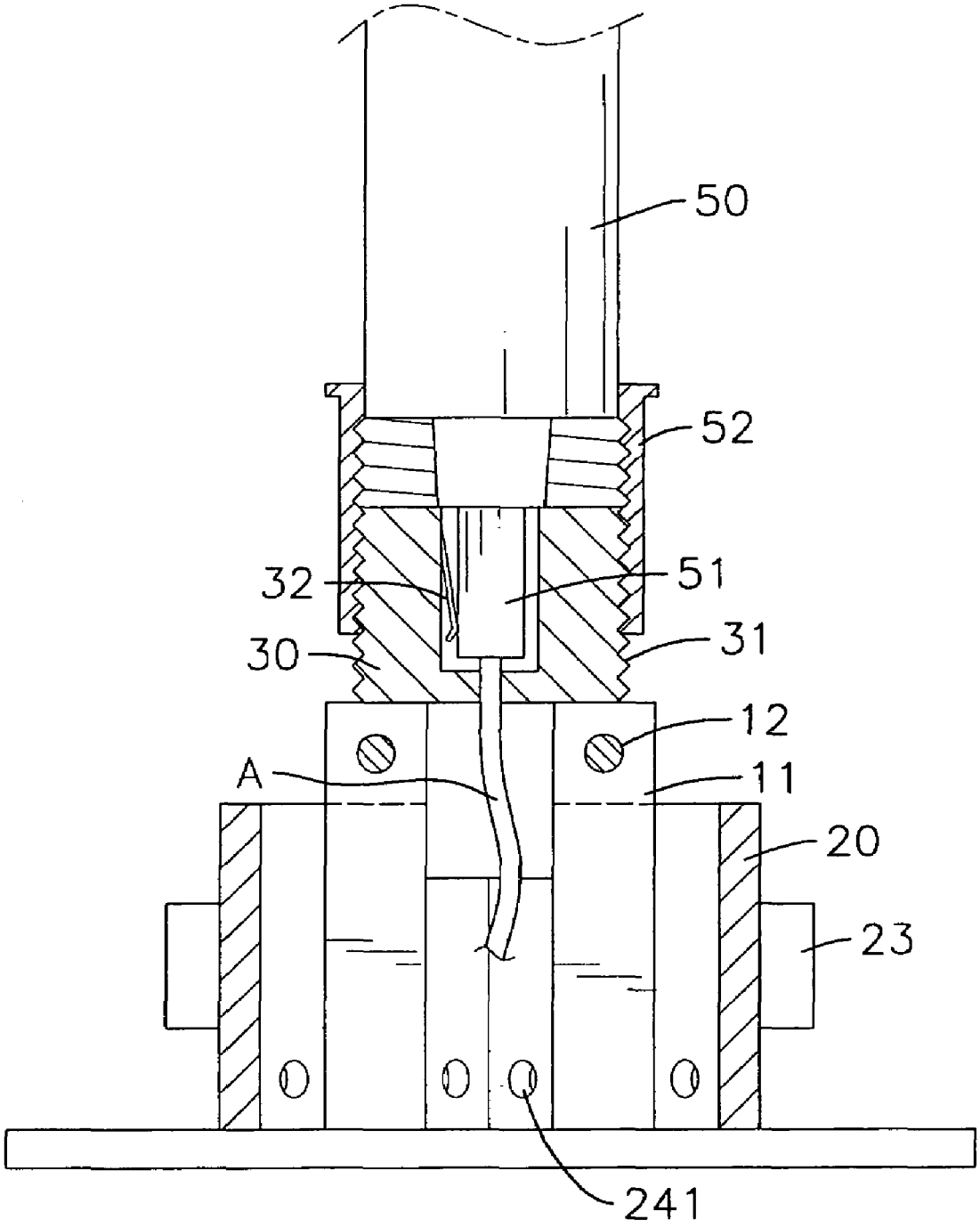
FIG. 3 is a cross sectional view of line 3—3 in FIG. 2.

With reference to FIGS. 1, 2 and 3, it is noted that the multidirectional socket assembly constructed in accordance with the present invention includes a base (10), an assembly block (20) and at least one socket device (30) (five are shown in the present invention). For simplicity, only the connection of two socket devices (30) to the assembly block (20) is introduced.

The base (10) has two first connection poles (11) extending from a top face thereof and respectively having a first lateral hole (12) (shown in FIG. 3) defined through each of the first connection poles (11).

The assembly block (20) includes a central through hole (21), side holes (22) defined in sides of the assembly block (20) and multiple pairs of first connection blocks (23) formed on the sides of the assembly block (20) and each first connection block (23) having a first threaded hole (24) defined therethrough. In this embodiment, the assembly block (20) is substantially cubic such that the assembly block (20) has four upright sides and there are four pairs of first connection blocks (23) respectively formed on the four upright sides. Each pair of first connection blocks (23) is formed on two opposite sides defining the side hole (22) of the assembly block (20).

The socket device (30) is a cylinder and has two open ends communicating with each other via a channel (not numbered). The socket device (30) has a threading (31) formed on an outer face thereof and a contact (32) formed on a side face defining the channel. The socket device (30) further has two pairs of second connection blocks (33) symmetrically formed on a bottom face of the socket device (30) and each second connection block (33) has a second threaded hole (34) defined through the second connection block (33). It is to be noted that a distance between two adjacent second connection blocks (33) is the same as a thickness of one first connection pole (11) and of one first connection block (23).

When the multidirectional socket assembly of the present invention is assembled, the two first connection poles (11) are extended through the central through hole (21) of the assembly block (20) to have the first lateral holes (12) of the first connection poles (11) aligned with the second threaded holes (34) of the second connection blocks (33) after one socket device (30) is positioned on top of the assembly block (20) and the top portions of the two first connection poles (11) are respectively sandwiched between each pair of the second connection blocks (33). Further a different socket device (30) is provided on one side of the assembly block (20). In order to mount the socket device (30) of the present invention on the side of the assembly block (20), each pair of first connection blocks (23) is sandwiched between two adjacent second connection blocks (33) and the first threaded hole (24) of each first connection block (23) is aligned with the second threaded hole (34) of each of the second connection blocks (34). Thereafter, a securing device (40) such as a threaded bolt is applied to extend through the aligned first lateral hole (12) and the second threaded holes (34) of the socket device (30) on top of the assembly block (20) and the aligned first threaded holes (24) of the first connection blocks (23) and the second threaded holes (34) of the second connection blocks (33) so as to secure engagement between the assembly block (20) and the socket devices (30) respectively on top and side of the assembly block (20). Because the assembly block (20) has four different upright side faces and there are two connection poles (11) extending from the central through hole (21) of the assembly block (20), the assembly block (20) of the present invention is able to combine with at most five different socket devices (30). Because mounting the socket device (30) to the other three sides of the assembly block (20) is the same, detailed description to the other three sides is thus omitted.

Figure 4:
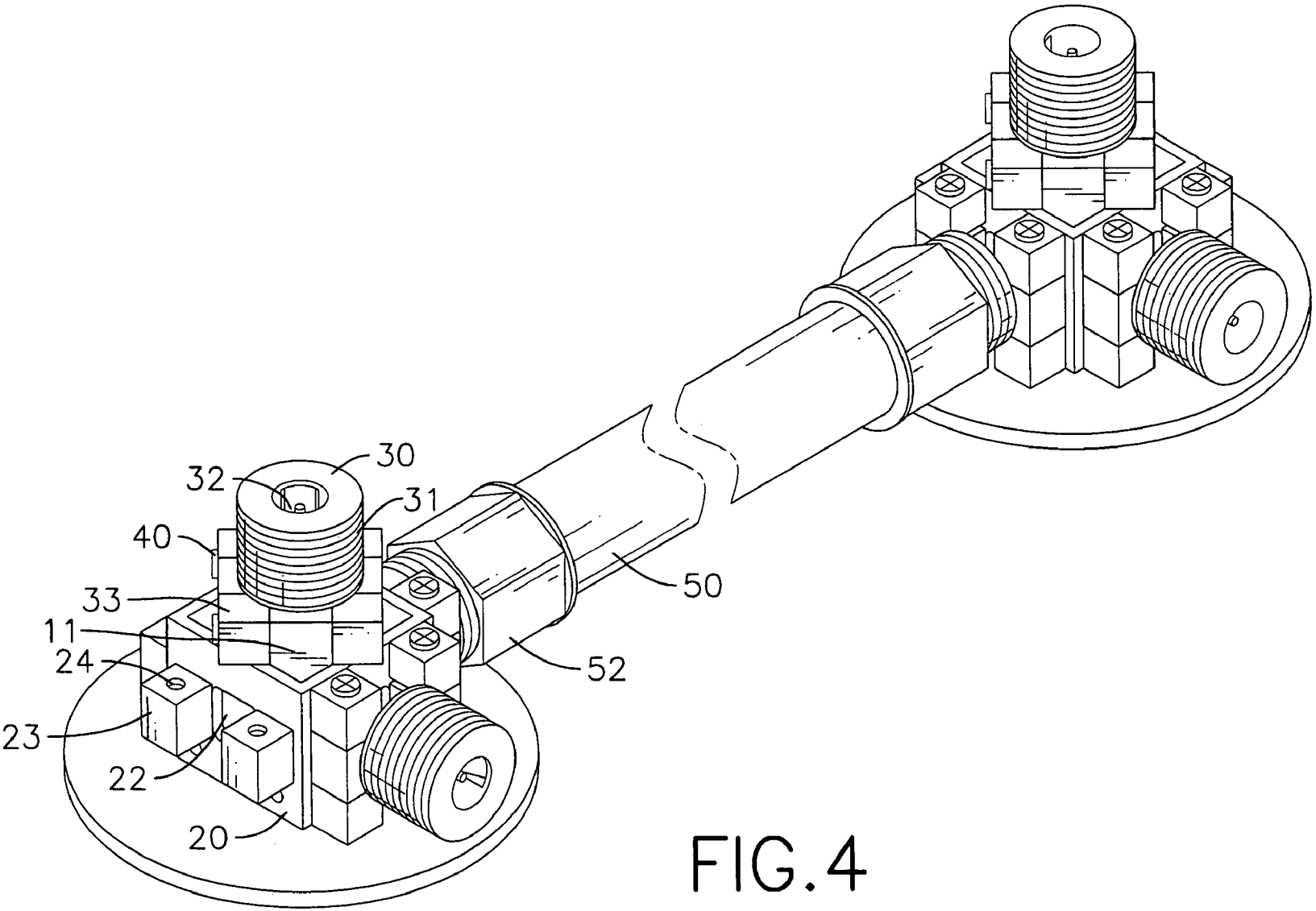
FIG. 4 is a perspective view showing the application of the multidirectional socket assembly of the present invention.

With reference to FIG. 4, it is noted that when the socket assembly of the present invention is in use with a light tube (50) having a securing nut (52) rotatably mounted on both ends of the light tube (50), the securing nut (52) is able to threadingly connect to the socket device (30) to allow the contact (32) inside the socket device (30) to provide power to the light tube (50) after a power line (A) (as shown in FIG. 3) is connected to the contact (32) and extended out of the assembly block (20) via the side hole (22) for connection with a power source.

Figure 5:
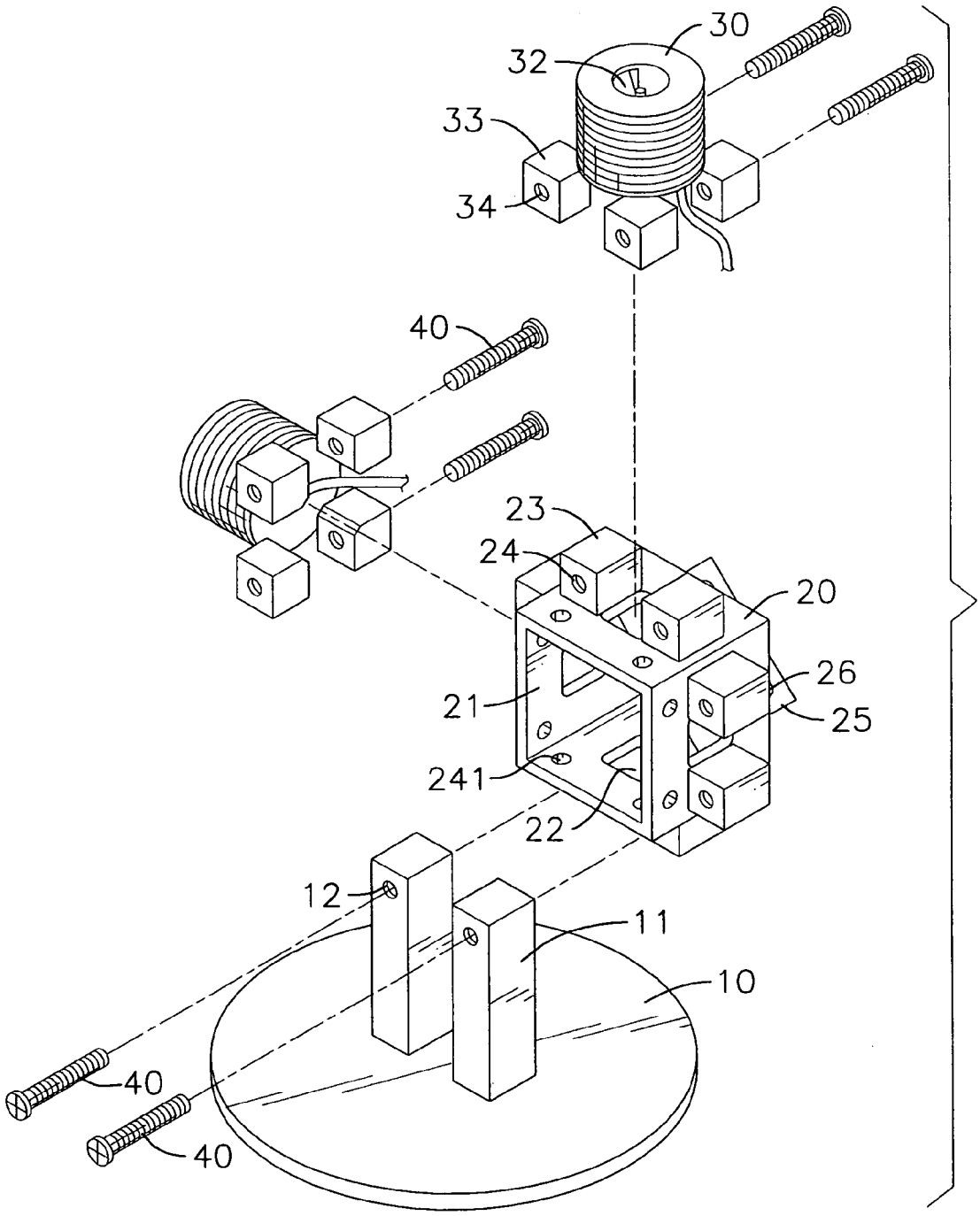
FIG. 5 is an exploded perspective view showing that the assembly block is connected to the connection poles and a pair of second connection poles are extended from the assembly block.
Figure 6:
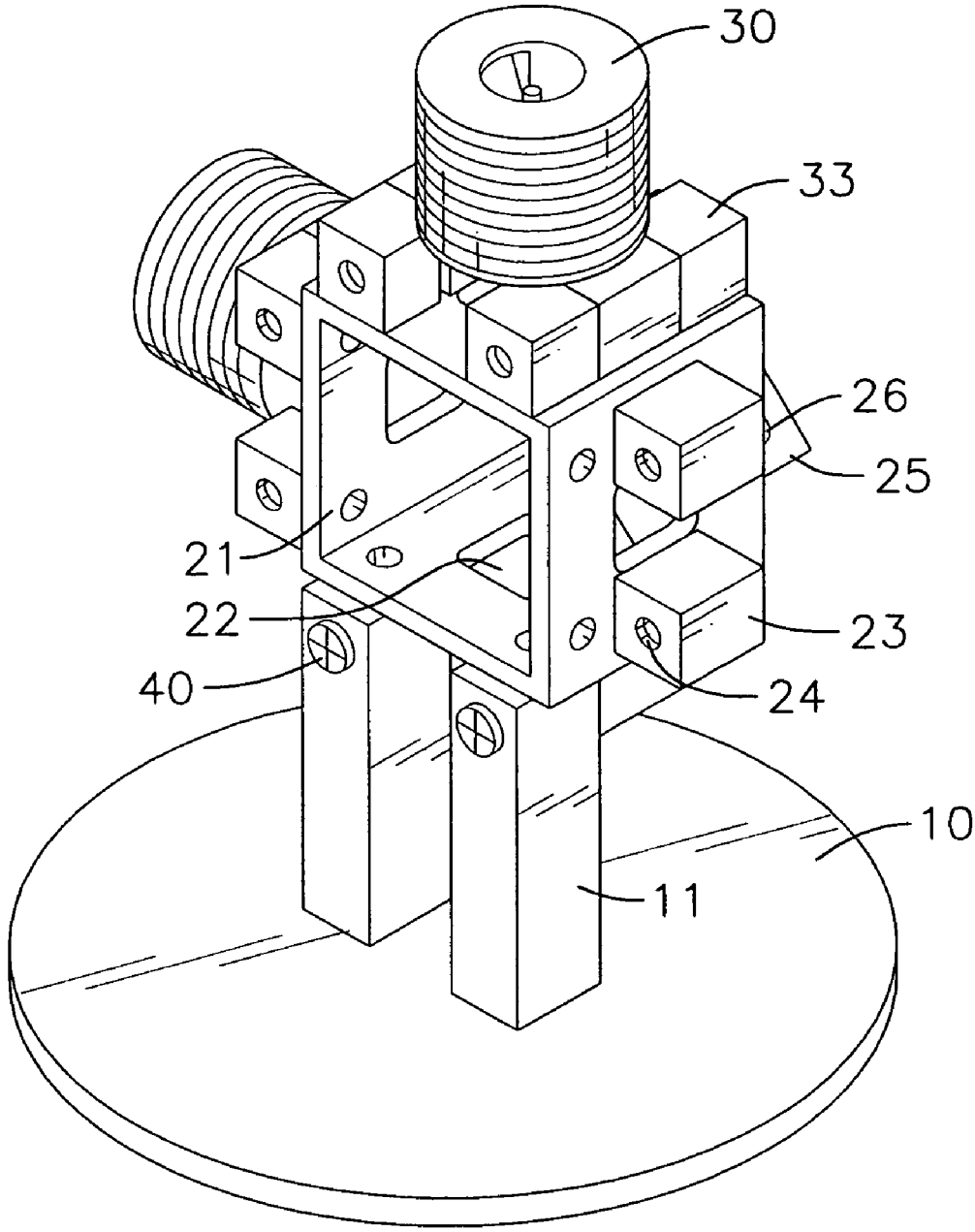
FIG. 6 is a perspective view showing the combined embodiment of the present invention in FIG. 5.
Figure 7:
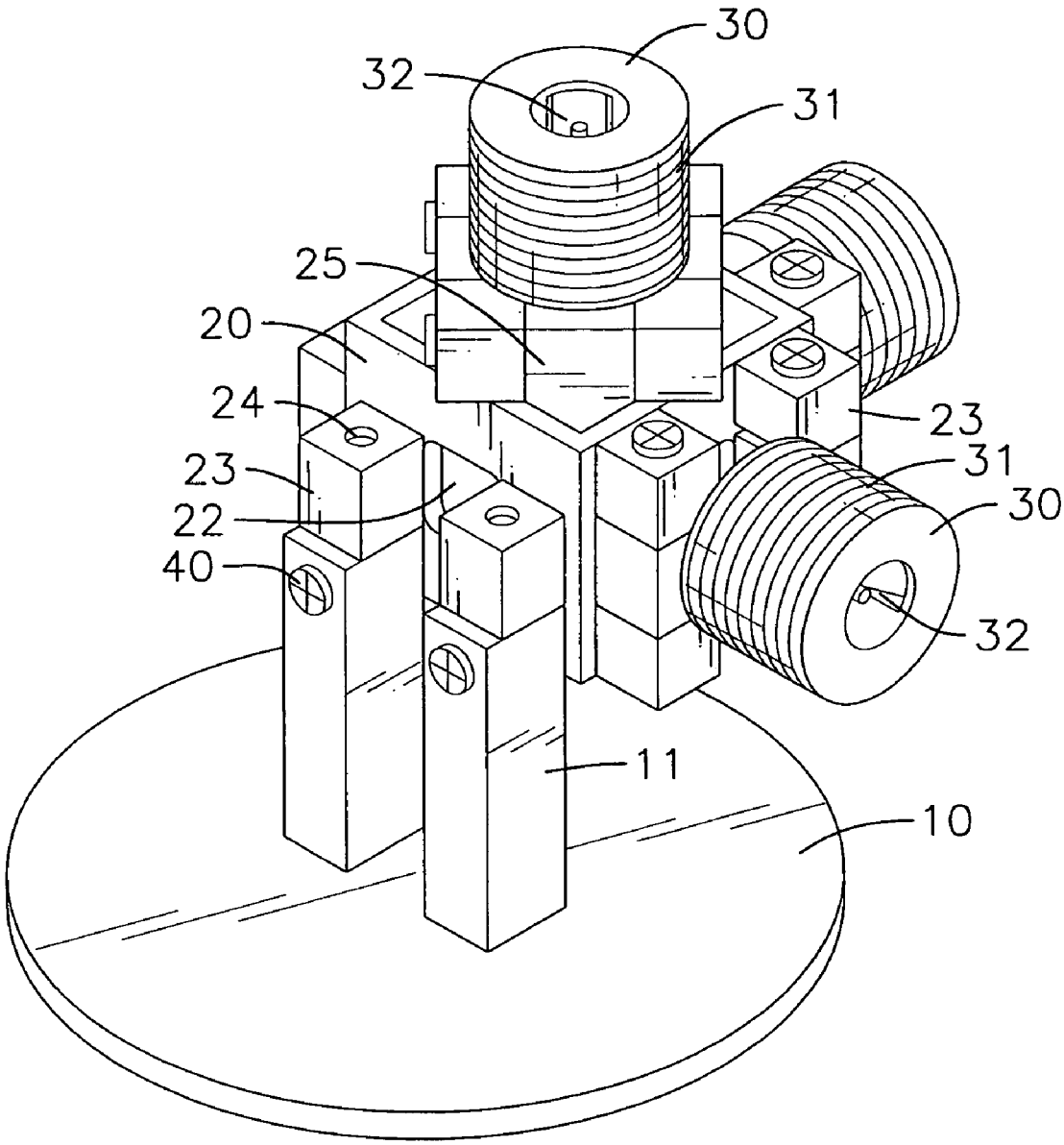
FIG. 7 is a perspective view showing that the assembly block is connected to the connection poles in a method different from that of FIG. 5.

With reference to FIGS. 5, 6 and 7 and referring back to FIG. 2, the assembly block (20) further has two second connection poles (25) respectively formed on two opposite sides defining the central through hole (21) of the assembly block (20) and having a second lateral hole (26) defined through each of the second connection pole (25) and two connection holes (241) defined in each side of the assembly block (20). It is noted from the addition of the second connection poles (25) that the socket device (30) on top of the assembly block (20) is able to be secured by both the first connection poles (11) and the second connection poles (25) using the securing devices (40) extending through the first lateral holes (12), the second lateral holes (26) and the second threaded holes (34) of the socket device (30). Therefore, when the assembly block (20) is tipped over, the two first connection poles (11) may connect to the assembly block (20) via the securing device (40) extending through the aligned first lateral holes (12) and the first threaded holes (24), as shown in FIG. 6. Also, the two first connection poles (11) may connect to the assembly block (20) via the securing device (40) extending through aligned first lateral holes (12) and the connection holes (241), as shown in FIG. 7.

Figure 8:
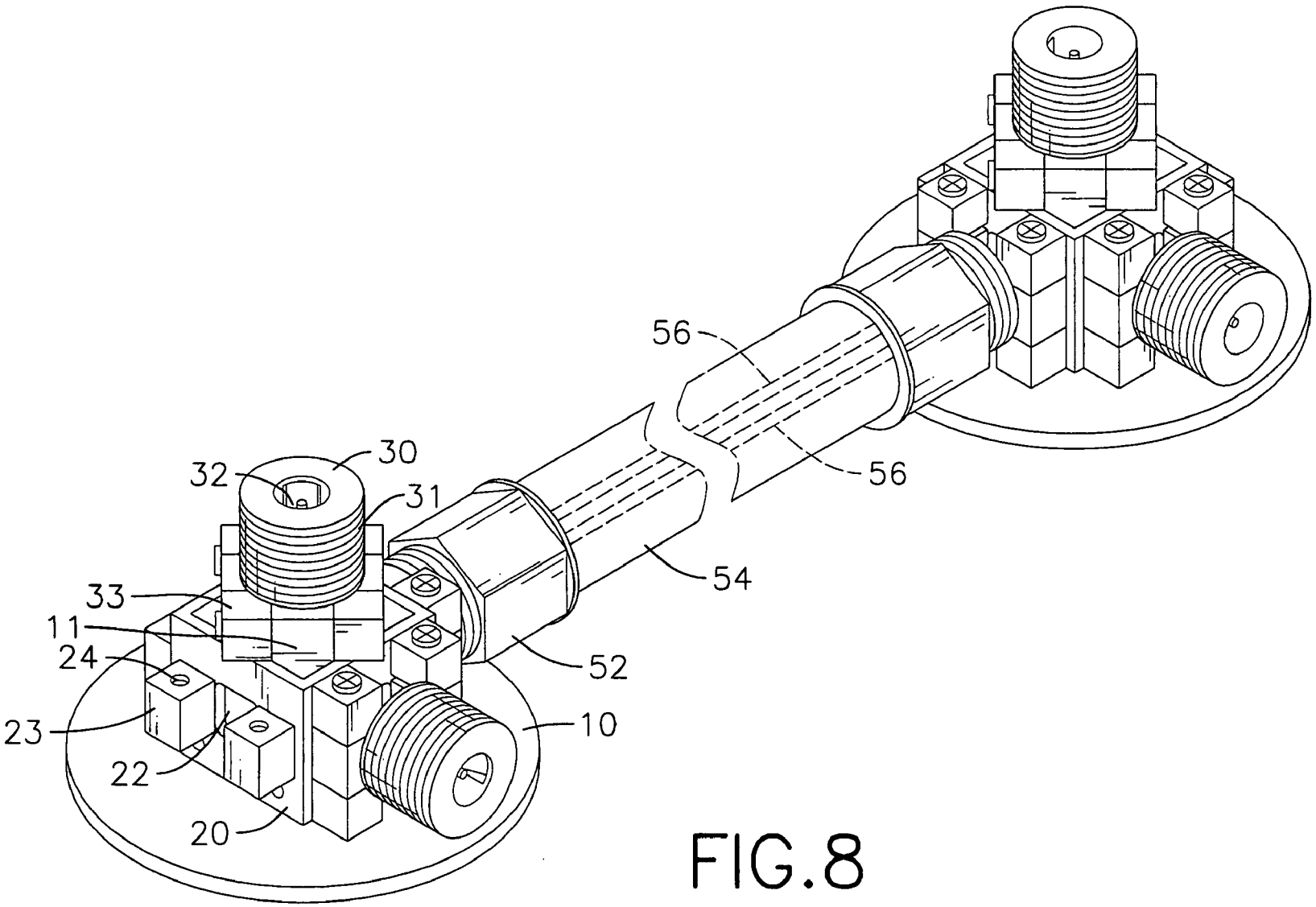
FIG. 8 is a perspective view showing a different embodiment of the present invention.

With reference to FIG. 8, it can be seen that the light tube (50) may be changed to an insulation tube (54) with wires (56) therein. That is, when the power line (A) is not connected to the contact (32) of one of the socket devices (30), the insulation tube (54) connected to that particular socket device (30) may help conceal the wires (56).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A socket assembly for connection with electronic elements extending in different directions, the socket assembly comprising:

a base;

two first connection poles extending from a top face of the base and each first connection pole having a first lateral hole defined therethrough;

an assembly block having a central through hole to allow extension of the two first connection poles, four side holes respectively defined in four sides of the assembly block to communicate with the central through hole and pairs of first connection blocks each formed on one side of the assembly block to sandwich the side hole, each first connection block having a first threaded hole;

at least one socket device having a threading formed on an outer periphery of the at least one socket device for connection with an electronic element, a contact formed inside the at least one socket device and having a power line extending out of the assembly block via the side hole for providing power to the electronic element and two pairs of second connection blocks formed on a bottom face of the at least one socket device, each second connection block having a second threaded hole aligned with the first threaded hole and the first lateral holes of the first connection poles so that each pair of second connection blocks sandwiches therebetween one of the first connection blocks and a top portion of the two first connection poles; and securing devices extending through the aligned second threaded hole and the first threaded hole as well as the first lateral hole and the second threaded hole to secure engagement between the at least one socket device and the assembly block.

2. The socket assembly as claimed in claim 1, wherein there are four socket devices respectively mounted on the four upright sides of the assembly block and one socket device mounted on a top side of the assembly block.

3. The socket assembly as claimed in claim 2, wherein two second connection poles are formed on an inner face defining the central through hole and each second connection pole has a second lateral hole to align with the socket device on top of the assembly block such that the socket device on top of the assembly block is able to connect to the first connection poles and the second connection poles via the securing devices extending through alignment among the second threaded holes, the first lateral holes and the second lateral holes.

4. The socket assembly as claimed in claim 3, wherein a distance between two adjacent second connection blocks is the same as a thickness of one first connection pole and of one first connection block.

5. The socket assembly as claimed in claim 4, wherein each of the securing devices is a threaded bolt.

* * * * *